United States Patent [19]

Lombard

[11] Patent Number: 4,653,234

[45] Date of Patent: Mar. 31, 1987

[54] WORKPIECE HOLDER APPARATUS FOR SURFACING OPTICAL LENSES

[75] Inventor: Gérard Lombard, Velaines, France

[73] Assignee: Essilor International Cie Generale d'Optique, Creteil, France

[21] Appl. No.: 643,373

[22] Filed: Aug. 23, 1984

[30] Foreign Application Priority Data

Sep. 2, 1983 [FR] France ..... 83 14110

[51] Int. Cl.[4] ..... B24B 41/06

[52] U.S. Cl. ..... 51/216 LP; 51/284 R

[58] Field of Search ..... 51/284 R, 277, 216 R, 51/216 LP, 237 R, 131.2, 235, 238 GG, 238 S, 281 R; 384/109

[56] References Cited

U.S. PATENT DOCUMENTS

| | | | |
|---|---|---|---|
| 2,441,108 | 5/1948 | Turner | 51/216 |
| 2,736,993 | 3/1956 | Tripp | 51/131 |
| 3,082,013 | 3/1963 | Thielenhaus | 51/235 X |
| 3,210,894 | 10/1965 | Bentley et al. | 51/277 X |
| 3,499,641 | 3/1970 | Peterson | 269/22 |
| 3,591,987 | 7/1971 | Porath | 51/238 S X |
| 3,886,696 | 6/1975 | Bruck | 51/237 R X |
| 4,373,991 | 2/1983 | Banks | 51/281 R X |

FOREIGN PATENT DOCUMENTS

| | | |
|---|---|---|
| 1041832 | 10/1958 | Fed. Rep. of Germany . |
| 1467951 | 2/1967 | France . |
| 2204990 | 5/1974 | France . |

*Primary Examiner*—Frederick R. Schmidt
*Assistant Examiner*—Debra S. Meislin
*Attorney, Agent, or Firm*—Charles E. Brown; Charles A. Brown

[57] ABSTRACT

A workpiece holder apparatus is disclosed for use with a surfacing tool for surfacing optical lenses having a surface of revolution especially afocal ophthalmic lenses. A workpiece holder comprises a chamber having an endwall, a sidewall and an open end, for receiving an optical lens. The chamber is connected in operation to a source of compressed air, and an air cushion is established between the endwall and the lens. There is radial clearance annularly between the edge of the sidewall and the edge of the lens. The air cushion is controlled by an annular projection protruding from the endwall, in cooperation with a facing portion of the lens. The entire workpiece holder is adapted to be fitted on a conventional fluid actuator for applying the lens against the surfacing tool.

11 Claims, 3 Drawing Figures

FIG. 2
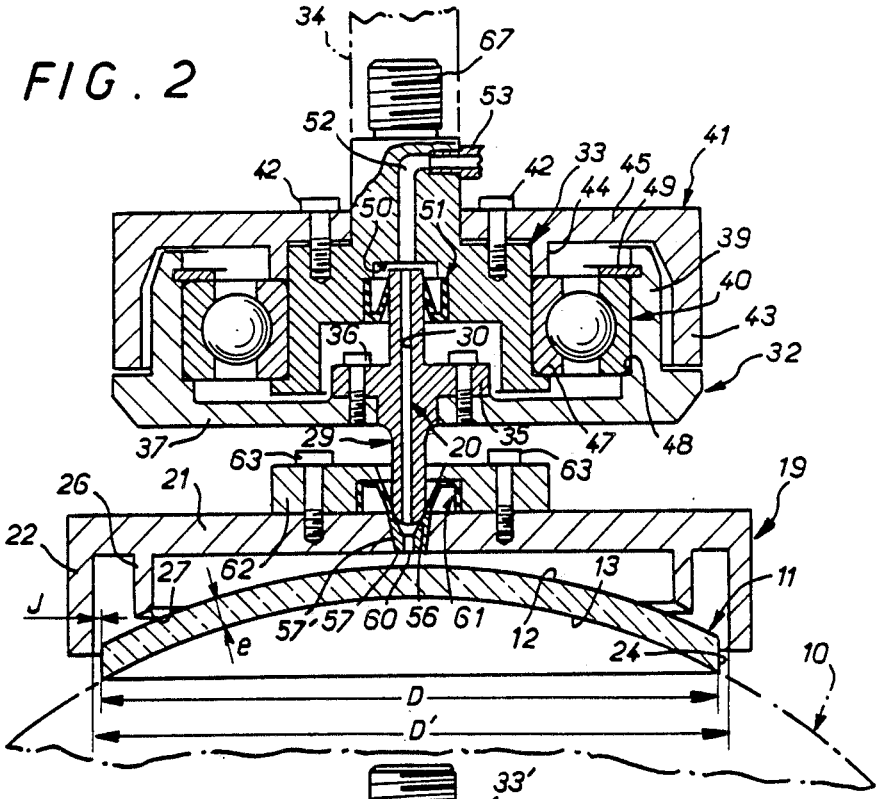
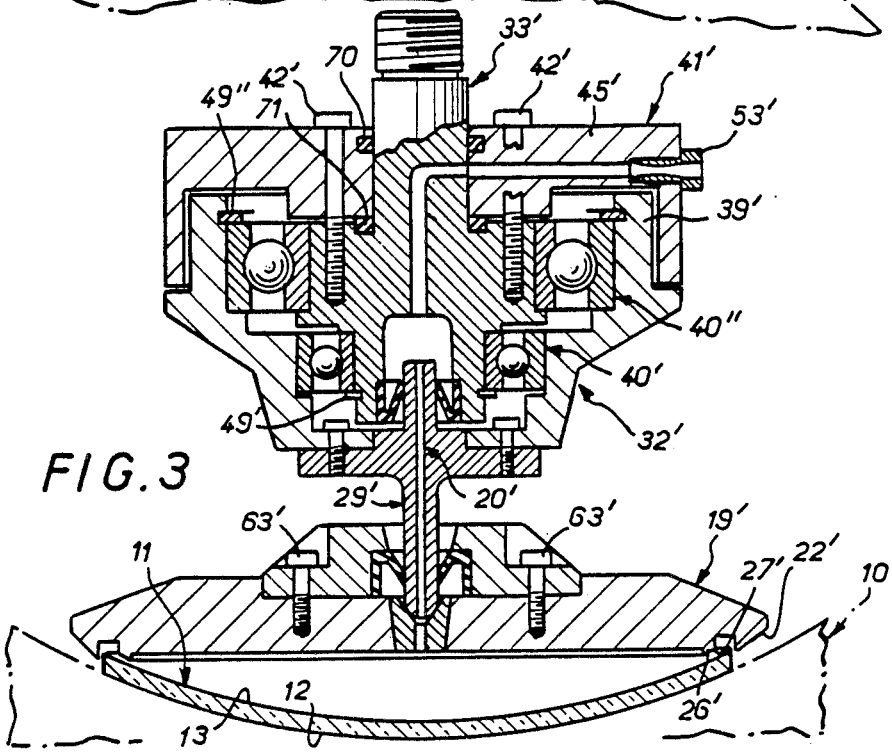
FIG. 3

WORKPIECE HOLDER APPARATUS FOR SURFACING OPTICAL LENSES

BACKGROUND OF THE INVENTION

The present invention relates generally to surfacing optical lenses having at least one surface of revolution and more particularly though not exclusively to such optical lenses having two spherical faces and having a relatively small ratio of thickness to diameter.

Such is the case for example with ophthalmic lenses namely afocal ophthalmic lenses such as those of tinted glass adapted for use in sunglasses. Such afocal ophthalmic lenses usually having a relatively small thickness for a relatively larger diameter.

The front and rear faces of such afocal ophthalmic lenses are normally rigorously concentric at all points such that a light ray entering through any point on the front face exits through a substantially axially aligned point without any deviation other than that due to mere transverse offset caused !y the refraction of the thickness of the material traversed.

Although the front and rear faces of such an afocal ophthalmic lens are commonly referred to as parallel, such an afocal ophthalmic lens may be considered a plate with parallel faces at all points.

Usually the surfacing of such an optical lens having at least one spherical surface is carried out by securement in a workpiece holder and the workpiece holder applying the lens against a rotatable surfacing tool.

To the present day the optical lens to be surfaced is typically secured rigidly to such a workpiece holder either by a spot of low melting point metal or by suction.

Now, with afocal ophthalmic lenses it is not uncommon to find, if only locally, a defect of parallelism between the front and rear faces of such an optical lens referred to as a prism effect, a light ray being deviated with respect to its normal optical path through the optical lens as if it traversed a prism.

The reason may reside notably in the fact that since the optical lens is relatively rigidly secured to the workpiece holder which applies it against the surfacing tool, the optical lens has no freedom of movement relative to the workpiece holder and may therefore be locally squeezed or pinched between the workpiece holder and the surfacing tool, with nonuniform removal of material along the surface, if its geometrical axis does not coincide with that of workpiece holder.

Now, in practice, there is rather frequently a deviation between the geometrical axis of such a lens to be surfaced and the axis either of the spot of low melting point metal or the recess in which the lens is accommodated when it is held by negative pressure, and therefore that of the corresponding workpiece holder.

If the deviation between the axes does not exceed 0.01 to 0.02 mm, the surface of the lens concerned may be considered to be uniformly surfaced. Such is not the case when the deviation is greater. Yet with the formation of a spot of low melting point metal on the lens to be surfaced or with the recess for receiving the lens when hold by negative pressure, mounting tolerances are generally greater than 0.1 mm for the distances between the axes. Moreover, in addition to the effect of such deviation between the axes is that due to the want of alignment between the geometrical axis of the lens to be surfaced and the axis of its peripheral edge. Such deviation and/or want of alignment of the axes is the source of the prism effect to be avoided.

In German DAS 1,041,832 which pertains to surfacing of lens workpieces whose ratio of thickness to diameter is relatively large, such as in piezo-electric elements or certain optical lenses for optical instruments in particular, in which there is a chamber for receiving the lens connected by a conduit to a source of compressed air. In an embodiment of this patent there is a pneumatic cushion formed between the endwall of the cavity and the workpiece, with radial play illustrated in the drawing between the peripheral edge of the workpiece and the sidewall of the chamber. A return line carrying the compressed air from the chamber back toward the source.

Such an arrangement is not suitable for surfacing relatively thin workpiece and when there is no control of the position of the workpiece relative to the chamber in which it is received.

OBJECT AND SUMMARY OF THE INVENTION

An object of the present invention is the provision of a workpiece holder apparatus for surfacing relatively thin workpieces such as optical lenses.

According to the invention there is provided a workpiece holder apparatus for optical lenses having a surface of revolution, said workpiece apparatus comprising a workpiece holder including a chamber having an endwall, a sidewall and an open end and being adapted to receive a lens to be surfaced, a conduit adapted to connect said chamber to a source of compressed air whereby an air cushion is formed between the lens and an endwall of said chamber when said chamber is in communication with the source of compressed air, said chamber being sized so as to define radial clearance between the peripheral edge of the lens and the sidewall of the chamber when the lens is received in said chamber, an annular projection protruding from the endwall of said chamber toward the open end thereof for controlling the air cushion in cooperation with a portion of the lens.

The optical lens is thus not rigidly secured to the workpiece holder but is mounted freely with respect to the workpiece holder and provided that the radial clearance is adequate there is a dual freedom of movement of the lens.

First of all, under the contact with the surfacing tool the lens is free to revolve about its axis and relative to the workpiece holder. Further, the lens may to a greater or lesser degree change its inclination and/or movement relative to the workpiece holder to better adjust its position relative to the workpiece holder, possibly with the alignment of its geometrical axis and the axis of the peripheral edge of the lens so that the geometrical axis is in coincidence with the axis of the workpiece holder.

Owing to the novel annular projection according to the invention, the pneumatic cushion established between the lens and the bottom of the chamber is maintained constant in thickness from the beginning to the end of the surfacing operation thereby enabling constant control of the relative position of the lens with respect to the chamber and thereby the thickness or the amount of material removed by the associated surfacing tool.

Advantageously, there is a remarkable optimization of surfacing with the desired tolerance with regular if not uniform lapping and in particular with regard to afocal ophthalmic lenses a reduction or even the elimination of any prism defect of the optical lens which constantly balances itself during surfacing with respect to the surfacing tool.

By preference the chamber in the workpiece holder according to the invention is itself rotatably mounted. Its own rotation combined with that of the lens advantageously contributes to the sought after uniform lapping.

In any event, and as distinguished over German DAS 1,041,832 discussed above, in which the pneumatic cushion is the sole means for applying the lens against the surfacing tool, the compressed air cushion of the present invention simply controls the position of the lens to be surfaced and therefore by the separation of functions the effectiveness of the means are enhanced. In fact, the workpiece holder of the present invention is associated with force application means for applying the lens against the surfacing tool which, as conventional, exerts a sufficient application force toward the surfacing tool.

Thus, the workpiece holder apparatus according to the invention may advantageously equip most conventional surfacing machines without substantial alterations, particularly if such machines already are equipped with a source of compressed air.

These and other features of the invention will be brought out in the description and appended claims, which description is given by way of example with reference to the accompanying schematic drawings.

BRIEF DESCRIPTION OF THE DRAWINGS

FIG. 2 is an enlarged sectional view of workpiece holder; and

FIG. 3 is a view similar to that of FIG. 2 relative to an alternative embodiment.

DESCRIPTION OF THE PREFERRED EMBODIMENTS

Figure 1:
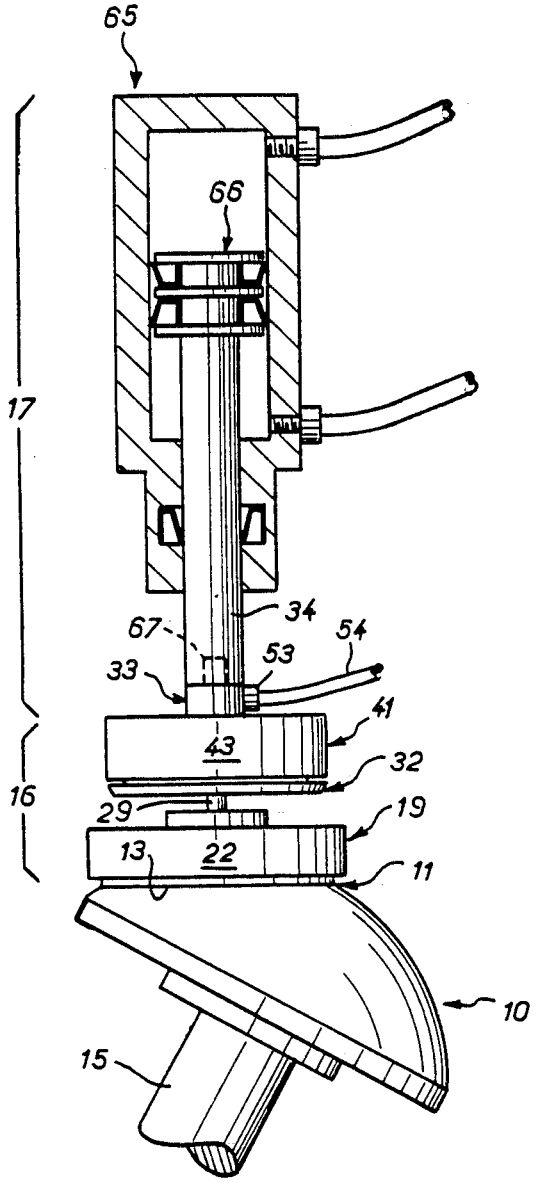
FIG. 1 is a partial view, partly in elevation and partly in section, of a surfacing machine equipped with a workpiece holder embodying the present invention.

As illustrated in the drawings, a spherical surface of an optical lens 11 is applied against a rotatable surfacing tool 10 having a corresponding spherical surface, the periphery of the lens 10 is circular. The optical lens 11 as illustrated is an afocal ophthalmic lens, that is an ophthalmic lens having a convex spherical front face 12 and a concave spherical rear face 13 substantially parallel to each other and therefore substantially concentric.

As is known the thickness e of such an ophthalmic lens is constant throughout and in practice relatively small, and therefore so is the ratio of the thickness e to the diameter of the lens, which diameter is always relatively large.

In FIGS. 1 and 2 the face of the optical lens 11 to be surfaced is the rear face 13 and in FIG. 3 the face to be surfaced is the front face 12. In the first case the working surface of the surfacing tool 10 is convex and in the second it is concave. In any event, the working surface of the surfacing tool 10 is spherical having a radius equal to that of the ultimate lens.

For its rotation the surfacing tool 10 is carried by a shaft 15 which is rotated by appropriate means (not shown) about its axis.

The above arrangements are not part of the invention per se and are well known to those skilled in the art and common place in conventional surfacing machines and therefore will not be described in greater detail.

A workpiece holder device 16 is employed for holding the optical lens 11 against the surfacing tool 10, force application means 17 for applying the workpiece holder toward the surfacing tool with adequate force.

The workpiece holder 16 comprises a chamber or cavity 19 for receiving the optical lens to be surfaced, the chamber or cavity 19 opening toward the surfacing tool 10. A conduit 20 described in greater detail herein below is adapted to be connected to a source of compressed air, not shown.

Overall, the cavity 19 comprises a transverse endwall 21 and a sidewall 22 extending from the periphery of the endwall 21. The sidewall 22 is of circular section like that of the optical lens 11 to be surfaced.

For reasons which will be brought out below, radial clearance J is provided annularly between the sidewall 22 of the cavity 19 and the peripheral edge 24 of the optical lens 11. In other words the inner diameter of the cavity D′ is slightly greater than the diameter of the optical lens 11 to be surfaced. As illustrated in FIGS. 1 and 2 for surfacing the rear face 13 of the optical lens 11 to be surfaced, the sidewall 22 of the cavity 19 is relatively axially elongate to compensate for the curvature of the optical lens 11 since substantially the entire optical lens, in this embodiment, is received in the cavity 19.

In any event the optical lens 11 must be sufficiently received in the chamber 19, as shown, so that at least part of the peripheral edge 24 of the optical lens 11 is received axially in the chamber 19, facing the sidewall 22 thereof.

According to the invention and for reasons which will become apparent below, the chamber 19 further comprises an annular projection 26 protruding from the endwall 21 of the cavity 19 parallel to the sidewall 22. The free edge of the annular projection 26 comprises a land 27 complementary to the configuration of the facing portion of the optical lens to be surfaced. In the FIGS. 1, 2 embodiment the configuration of the annular land 27 is part spherical and concave.

By preference, and as shown, the chamber 19 is mounted for swivelling. For example, as shown, the chamber 19 is swivelly mounted on an injection nozzle 29 having an axially extending inner bore 30 which is part of the conduit 20 adapted to connect the chamber 19 to the source of compressed air.

In practice the injection nozzle 29 is fixed to a casing 32 which in turn is mounted for rotation about a coupling 33 adapted to be fixed to a support rod 34 which is part of the associated force application means 17. For example, as shown, the injection nozzle 29 has midway along its length a radially extending flange 35 by which the injection nozzle 29 is affixed to the endwall 37 of casing 32 with the aid of screws 36.

The casing 32 also comprises a sidewall 39 upstanding from endwall 37. The sidewall 39 is spaced radially outwardly of and around coupling 33, and a ball bearing 40 is interposed between the sidewall 39 and coupling 33 as shown in FIGS. 1, 2. In this embodiment there is provided a cover 41 for protecting the ball bearing 40, which is fixed by screws 42 to the coupling 33. The cover 41 has a sidewall 43 which annularly surrounds, with clearance, the sidewall 39 of the casing 32.

An annular projection 44 concentric with the axis of the workpiece holder 16 and protruding from the endwall 45 of the cover 41 bears against the upper side of the inner race of the ball bearing 40 and a transverse shoulder 47 on the coupling 33 bears against the under side of the inner race 40. The under side of the outer race of the ball bearing 40 bears against a transverse shoulder 48 on the casing 32 while a split spring washer 49 engaged in an annular groove in the sidewall 39 of the casing bears against the upper side of the outer race of the bearing 40, maintaining the same in position.

The upper end of the injection nozzle 29, remote from the chamber 19, is received in an inner recess 50 in the coupling 33, an upwardly tapering lip of an annular seal 51 extending between the sidewall of the inner recess 50 and the upper end of the injection nozzle 29.

The coupling 33 has an axial channel 52 which communicates with the inner recess 50 and is part of the conduit 20 provided for communication of the chamber 19 with the compressed air source (not shown) which turns radially outwardly for connection through an endpiece 53 (FIG. 2) with a hose 54 (FIG. 1).

By preference, the chamber 19 is in simple bearing contact with the corresponding lower end 56 of the injection nozzle 29 in the central area 57 of the endwall 21 of the chamber. Thus, the workpiece holder 16 is adapted to be easily and quickly removed, depending on the diameter of the optical lens to be lapped, to provide a chamber 19 having a suitable diameter D' among a plurality of different chambers 19 having different diameters.

By preference, and as shown, the lower end 56 of the injection nozzle 29 which bears against the central area 57 of the chamber endwall 21 is spherical while the corresponding bearing surface of the central area 57 is preferably frustoconical. In the illustrated embodiment the central zone 57 of the chamber endwall 21 comprises an insert 57' of a suitable material secured in relation to the endwall 21. The insert 57' extends entirely through the endwall 21 and has a central axial bore which opens into the interior of the chamber 19 and defines part of the conduit 20 providing communication between the chamber 19 and the source of compressed air.

By preference, and as illustrated, a seal 61 preferably having a tapered lip, similar to seal 51 referred to above, but with the tapered lip tapering in the opposite direction, is in sealing contact with the lower end of the injection nozzle 29 adjacent the zone of bearing contact between the central area 57 and the lower end of the injection nozzle.

In the illustrated embodiment a seal housing 62 fixed by screws 63 to the endwall of the chamber 19 maintains the seal 61 in contact with the lower end of the injection nozzle 29.

In the illustrated embodiment the associated force application means 17 comprises a double action pneumatic actuator schematically represented by its cylinder body 65 and its piston 66. Like the surfacing tool 10 the pneumatic actuator may be of conventional design for surfacing machines.

The piston rod of the pneumatic actuator forms in practice the support rod 34 of the force application means 16.

In the illustrated embodiment, coupling 33 is fitted with a threaded end portion 67 by which the coupling 33 is threadedly affixed to the end of the support rod 34.

As will be noted in the FIG. 1 embodiment, the axis of the support rod 34 of the workpiece holder 16 is at an angle with respect to the axis of rotation of the surfacing tool 10 while being in the same plane as the latter, that is, the plane of the drawing.

In use, with the optical lens 11 to be surfaced bearing eccentrically against the surfacing tool 10 and the optical lens 10 received in the workpiece holder 16, the compressed air is supplied to the chamber 19 via conduit 20. An air cushion is thus established between the optical lens 11 to be surfaced and the chamber 19 circumscribed by the annular projection 26.

Initially the land on the annular projection 26 bears against the optical lens 11 to be surfaced and thereafter slightly away from the optical lens under the action of the compressed air introduced into the chamber 19, because the axial force due to the compressed air introduced into the chamber 19 is greater than forced applied by the associated force application means 17.

Thereupon there is produced, as illustrated in FIG. 2, a free space between the land 27 on the annular projections 26 in the chamber 19 and the corresponding portion of the surface of the lens to be surfaced. The compressed air supplied to the chamber 19 via conduit 20 bleeds or flows radially outwardly until an equilibrium between the axial forces is reached. In other words, the annular projection 26 in cooperation with the optical lens 11 to be surfaced ensures the control of the air cushion established between the chamber 19 and the optical lens 11.

In practice the free space between the land 27 at the free end of the annular projection 26 and the corresponding portion of the surface of the optical lens 11 to be surfaced is of the order of 0.02 and 0.03 mm.

In any event, on account of the previously mentioned radial clearance, the optical lens 11 to be surfaced is totally out of contact with the chamber 19, the compressed air flowing outwardly through the radial clearance J whereby the optical lens is not subjected to any pinching against the surfacing tool 10 by means of the workpiece holder 16 which ensures contact of the lens with the surfacing tool while at the same time permitting the optical lens to rotate about its axis inside the workpiece holder 16.

It goes without saying that the radial clearance J must be sufficient for the optical lens 11 to have the desired degree of freedom of movement. Preferably, the radial clearance is greater than 0.1 mm and values between 0.5 mm and 1 mm are particularly satisfactory. It will be understood that these numerical values are given by way of example and should not in any way be considered necessarily as limitations of the invention.

Moreover, owing to the eccentricity of the optical lens 11 relative to the surfacing tool 10, the rotation of the lens about its own axis may result simply from mere contact between the lens and the surfacing tool 10 due to the differential driving movement to which diametrically opposite sides of the lens are subjected.

Such is the case with the illustrated embodiment. But alternatively the rotation of the lens may be controlled or enhanced by power means of the type usually provided in conventional surfacing machines, and/or by compressed air supplied obliquely into the chamber 19.

Likewise there may be provided straight line translation in the plane passing through the axis of the support rod 34 and the axis of rotation of the surfacing tool 10, or the entire workpiece holder apparatus composing the workpiece holder 16 and the force application means 17 associated therewith, or of the surfacing tool 10.

According to another alternative arrangement there may be provided oscillation of the workpiece holder apparatus composed of the workpiece holder 16 and the force application means 17 in the aforementioned plane about the axis perpendicular to this plane.

Alternatively, the optical lens 11 to be surfaced may not be eccentric to the surfacing tool 10.

In any case, as will be readily appreciated, the force application means 17 permits the necessary disengagement movement for introducing the optical lens 11 to be surfaced into chamber 19 in the workpiece holder 16 before lapping and removing the same after lapping.

As illustrated in FIG. 3 the face of the optical lens 11 to be surfaced is the convex face, or in the case of an afocal ophthalmic lens, the convex face of the optical lens 11 to be surfaced after the concave face. The chamber 19' is very shallow and the sidewall 22' of the chamber 19' is very short axially, the concave face of the optical lens 11 then protrudes outside the chamber 19' instead of being received axially inside the chamber as in the previous embodiment.

The land 27' on the annular projection 26' of the chamber 19' has a generally convex spherical configuration instead of a concave configuration as in FIGS. 1 and 2. Otherwise the various features employed are similar to those described above with respect to FIGS. 1 and 2. In FIG. 3, the same reference numerals, but primed, designate parts corresponding to like parts found in FIGS. 1 and 2.

It will simply be indicated that in the embodiment of FIG. 3 two ball bearings 40', 40'' are provided between the casing 32' and the coupling 33'. A split spring washer 49' is engaged in a groove in the coupling 33' for holding ball bearing 40' and a split spring washer 49'' is engaged in a groove in the casing 32' for the ball bearing 40''. The internal recess in the casing 32' is stepped.

It will also be pointed out that two seals 70, 71 are provided between the cover 41' and the coupling 33', the first which acts radially being disposed in the endwall 45' of the cover 41' where the coupling 33' passes through the same, and the second which acts axially under the action of the screws 42' being clamped between the endwall 45' and the coupling 33'. The lateral outlet of the conduit 20' is through the cover 41' between the axially spaced apart seals 70, 71.

Of course, the present invention is not limited to the illustrated and described embodiments but admits of various alternative and modifications which will be understood to those skilled in the art.

Further, the field of the invention is not limited to that of surfacing afocal ophthalmic lenses with spherical faces nor even ophthalmic lenses. On the contrary, the invention is directed more generally to all optical lenses having a surface or surfaces of revolution.

Nonetheless, on account of the relatively slight ratio of thickness to diameter in ophthalmic lenses, the present invention is more particularly adapted to the same since, as the operating surface is relatively great, the pressure required for a given axial force is relatively small, and therefore highly suited for use of compressed air. The overturning moment caused by the surfacing force which is to be counterbalanced by the pressure is also likewise relatively small.

What I claim is:

1. A workpiece holder apparatus for optical lenses having a surface of revolution, said workpiece apparatus comprising a workpiece holder including a chamber having an endwall, a sidewall and an open end and being adapted to receive a lens to be surfaced, means for supplying compressed air to said chamber including a conduit having means for connection to a source of compressed air whereby an air cushion is formed between the lens and the endwall of said chamber when compressed air is supplied to said chamber, said chamber being sized so as to define radial clearance between a peripheral edge of the lens and the sidewall of the chamber when the lens is received in said chamber, an annular projection having radially inner and outer sidewalls and an endwall spaced from said chamber endwall, said projection protruding from the endwall of said chamber toward the open end thereof with said projection endwall in cooperation with a portion of the lens defining means for controlling the air cushion whereby compressed air from said chamber flows through said means for controlling said air cushion and then out of said chamber through said radial clearance between the peripheral edge and said sidewall.

2. The workpiece holder apparatus according to claim 1, wherein there are means swivelly mounting said chamber relative to said conduit.

3. A workpiece holder apparatus for optical lenses having a surface of revolution, said workpiece apparatus comprising a workpiece holder including a chamber having an endwall, a sidewall and an open end and being adapted to receive a lens to be surfaced, means for supplying compressed air to said chamber including a conduit having means for connection to a source of compressed air whereby an air cushion is formed between the lens and the endwall of said chamber when compressed air is supplied to said chamber, said chamber being sized so as to define radial clearance between a peripheral edge of the lens and the sidewall of the chamber when the lens is received in said chamber, an annular projection having radially inner and outer sidewalls and an endwall spaced from the endwall of said chamber, said projection protruding from the endwall of said chamber toward the open end thereof, said projection endwall in cooperation with a portion of the lens defining means for controlling the air cushion, an injection nozzle for the compressed air coupled to said conduit, means mounting said chamber for rotation about said injection nozzle, said injection nozzle being in simple bearing contact with a central area of said chamber endwall.

4. The workpiece holder apparatus according to claim 3, wherein said injection nozzle has a spherical end, said chamber endwall having a frustoconical portion in said central area, said injection nozzle bearing against said chamber endwall through said spherical end and said frusto-conical portion in said central area of the endwall.

5. The workpiece holder apparatus according to claim 4 together with a casing, the injection nozzle being fixed to said casing, a coupling, said casing being rotatably mounted about said coupling, said coupling having means for securing the entire workpiece holder apparatus to a support rod, and said conduit being coupled to said injection nozzle through said casing and said coupling.

6. A workpiece holder apparatus for optical lenses having a surface of revolution, said workpiece apparatus comprising a workpiece holder including a chamber having an endwall, a sidewall and an open end and being adapted to receive a lens to b surfaced, means for supplying compressed air to said chamber including a conduit having means for connection to a source of compressed air whereby an air cushion is formed between the lens and the endwall of said chamber when compressed air is supplied to said chamber, said chamber being sized so as to define radial clearance between a peripheral edge of the lens and the sidewall of the chamber when the lens is received in said chamber, an annular projection having radially inner and outer sidewalls and an endwall spaced from the endwall of said chamber, said projection protruding from the endwall of said chamber toward the open end thereof, said projection endwall in cooperation with a portion of the lens defining means for controlling the air cushion, said annular projection endwall being an annular land with a surface of revolution complementary to a portion of the lens opposite said land when the lens is received in said chamber.

7. The workpiece holder apparatus according to claim 3, wherein said annular projection has an annular land of configuration complementary to a portion of the lens opposite said land when the lens is received in said chamber.

8. The workpiece holder apparatus according to claim 1, together with an injection nozzle, said chamber being swivelly mounted about said injection nozzle with said injection nozzle forming an end of said conduit for injecting compressed air into said chamber, said nozzle being in simple bearing contact with a central area of said chamber endwall.

9. The workpiece holder apparatus according to claim 8, wherein said injection nozzle has a spherical end, said chamber endwall having a frustoconical portion in said central area, said injection nozzle leaning against said chamber endwall through said spherical end said frustoconical portion in said central area of the endwall.

10. The workpiece holder apparatus according to claim 9, wherein there is a casing, the injection nozzle being fixed to said casing, a coupling, means rotatably mounting said casing about said coupling, and said coupling having means for mounting the entire workpiece holder apparatus to a support rod.

11. The workpiece holder apparatus according to claim 1, wherein said annular projection has an annular land of configuration complementary to a portion of the lens opposite said land when the lens is received in said chamber.

* * * * *